US010369819B2

(12) United States Patent
Yamaya

(10) Patent No.: US 10,369,819 B2
(45) Date of Patent: Aug. 6, 2019

(54) RECORDING APPARATUS

(71) Applicant: SEIKO EPSON CORPORATION, Tokyo (JP)

(72) Inventor: Keisuke Yamaya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/921,212

(22) Filed: Mar. 14, 2018

(65) Prior Publication Data

US 2018/0281481 A1 Oct. 4, 2018

(30) Foreign Application Priority Data

Mar. 29, 2017 (JP) ..... 2017-065584

(51) Int. Cl.
*B41J 3/407* (2006.01)
*B41J 13/03* (2006.01)
*B41J 13/26* (2006.01)

(52) U.S. Cl.
CPC ..... *B41J 13/03* (2013.01); *B41J 13/26* (2013.01)

(58) Field of Classification Search
USPC ..... 347/104; 271/274; 400/625
See application file for complete search history.

(56) References Cited

U.S. PATENT DOCUMENTS 5,594,486 A * 1/1997 Kiyohara ..... B41J 11/005 271/274
2002/0003982 A1 1/2002 Iwasaki et al.
2004/0109056 A1* 6/2004 Kang ..... B41J 13/0009 347/104

FOREIGN PATENT DOCUMENTS

JP 64-022576 A 1/1989
JP 04-275564 A 10/1992
JP 10-035941 A 2/1998
JP 11-300950 A 11/1999

* cited by examiner

*Primary Examiner* — Lam S Nguyen
(74) *Attorney, Agent, or Firm* — Workman Nydegger

(57) ABSTRACT

A recording apparatus includes a printing unit that performs a recording on a first cut sheet, a sheet feed tray on which the first cut sheet is mounted, a sheet feed roller that transport the first cut sheet in a transport direction from the sheet feed tray toward the printing unit, a transport roller disposed downstream of the sheet feed roller in the transport direction and that holds the first cut sheet with a driven roller to transport the first cut sheet in the transport direction, and a single motor that drives the sheet feed roller and the transport roller, in which when the sheet feed roller and the transport roller are simultaneously driven by the single motor, a transport speed of the first cut sheet by the sheet feed roller is configured to be higher than a transport speed of the first cut sheet by the transport roller.

5 Claims, 15 Drawing Sheets

RECORDING APPARATUS

BACKGROUND

1. Technical Field

The present invention relates to a recording apparatus that records on a recording medium.

2. Related Art

In the related art, by ejecting a liquid such as ink from a liquid ejecting head serving as an example of a recording head constituting a recording unit to a sheet serving as an example of a recording medium, an ink jet type printer that records (prints) an image including a character, a figure, and the like on the sheet is known as a type of a recording apparatus. In such a printer, an image is recorded (printed) correctly with respect to the transported sheet by transporting the sheet in a normal orientation with respect to the recording unit (recording head). Therefore, for example, in a case where the sheet is transported in a state deviated from the normal orientation, such as being transported obliquely with respect to a transport direction, a technique is proposed that a skew removal is performed to fix the sheet in the normal orientation (for example, refer to JP-A-1-22576).

That is, by setting a transport speed of the sheet by a sheet feed roller higher than a transport speed of the sheet by a transport roller, the technique of skew removal in the related art is a technique to correct the sheet in the normal orientation by pushing the sheet from behind when a leading edge of the sheet reaches the transport roller, even when the sheet fed from a sheet feed tray is supplied (transported) obliquely by the sheet feed roller.

However, in the technique of skew removal in the related art, a drive motor for driving a sheet feed roller as a drive roller and a drive motor for driving a transport roller as a drive roller are independent motors, respectively. When the skew removal of a sheet is performed, it is necessary to drive synchronously the drive motor for driving the sheet feed roller and the drive motor for driving the transport roller, that is, to drive simultaneously, and in the simultaneous driving, it is necessary to drive each roller so that a transport speed of the sheet by the sheet feed roller is higher than a transport speed of the sheet by the transport roller. Therefore, in such a recording apparatus provided with the technique of skew removal in the related art, a drive control technique of two drive motors for respectively driving two drive rollers is required, and there is a problem that it is not easy to perform the skew removal of the sheet.

SUMMARY

An advantage of some aspects of the invention is to provide a recording apparatus which can easily perform skew removal of a recording medium transported in a transport direction by two drive rollers.

Hereinafter, means of the invention and operation effects thereof will be described.

According to an aspect of the invention, there is provided a recording apparatus including a recording unit that performs a recording on a recording medium, a medium mounted unit on which the recording medium is mounted, a first drive roller that transports the recording medium in a transport direction from the medium mounted unit toward the recording unit. A second drive roller disposed downstream of the first drive roller in the transport direction and that holds the recording medium with a driven roller to transport the recording medium in the transport direction, and a drive portion that drives the first drive roller and the second drive roller, in which when the first drive roller and the second drive roller are simultaneously driven by the single drive portion, a transport speed of the recording medium by the first drive roller is higher than a transport speed of the recording medium by the second drive roller.

According to this configuration, it is possible to easily and simultaneously drive two drive rollers and to easily perform skew removal of the recording medium transported in the transport direction by the two drive rollers simultaneously driven.

In the recording apparatus, it is preferable that a roller diameter of the first drive roller be larger than a roller diameter of the second drive roller.

According to this configuration, it is possible to easily cause a transport speed of the recording medium by the first drive roller to be higher than a transport speed of the recording medium by the second drive roller.

In the recording apparatus, it is preferable that a rotational speed of the first drive roller when driven simultaneously by the single drive portion be higher than a rotational speed of the second drive roller.

According to this configuration, it is possible to easily cause the transport speed of the recording medium by the first drive roller to be higher than the transport speed of the recording medium by the second drive roller in a state of being simultaneously driven by the single drive portion.

It is preferable that the recording apparatus further include a driving force transmission unit that transmits a driving force from the single drive portion to the first drive roller, in which after the recording medium is held with the driven roller and is in a state of capable of being transported by the second drive roller, the driving force transmission unit release the driving force transmitted to the first drive roller so as not to transmit the driving force.

According to this configuration, it is possible to stably transport the recording medium in the transport direction in a skew removed state by the second drive roller.

In the recording apparatus, it is preferable that the recording unit include a recording head that performs a recording on a recording medium, and a head moving portion provided with the recording head, and that is movable in a direction intersecting with the transport direction, and the driving force transmission unit include a switching mechanism that switches the driving force to the first drive roller between transmission and non-transmission by movement of the head moving portion.

According to this configuration, it is possible to switch the transmission of the driving force to the first drive roller by utilizing the recording unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printer according to one embodiment will be described with reference to the drawings.

Figure 1:
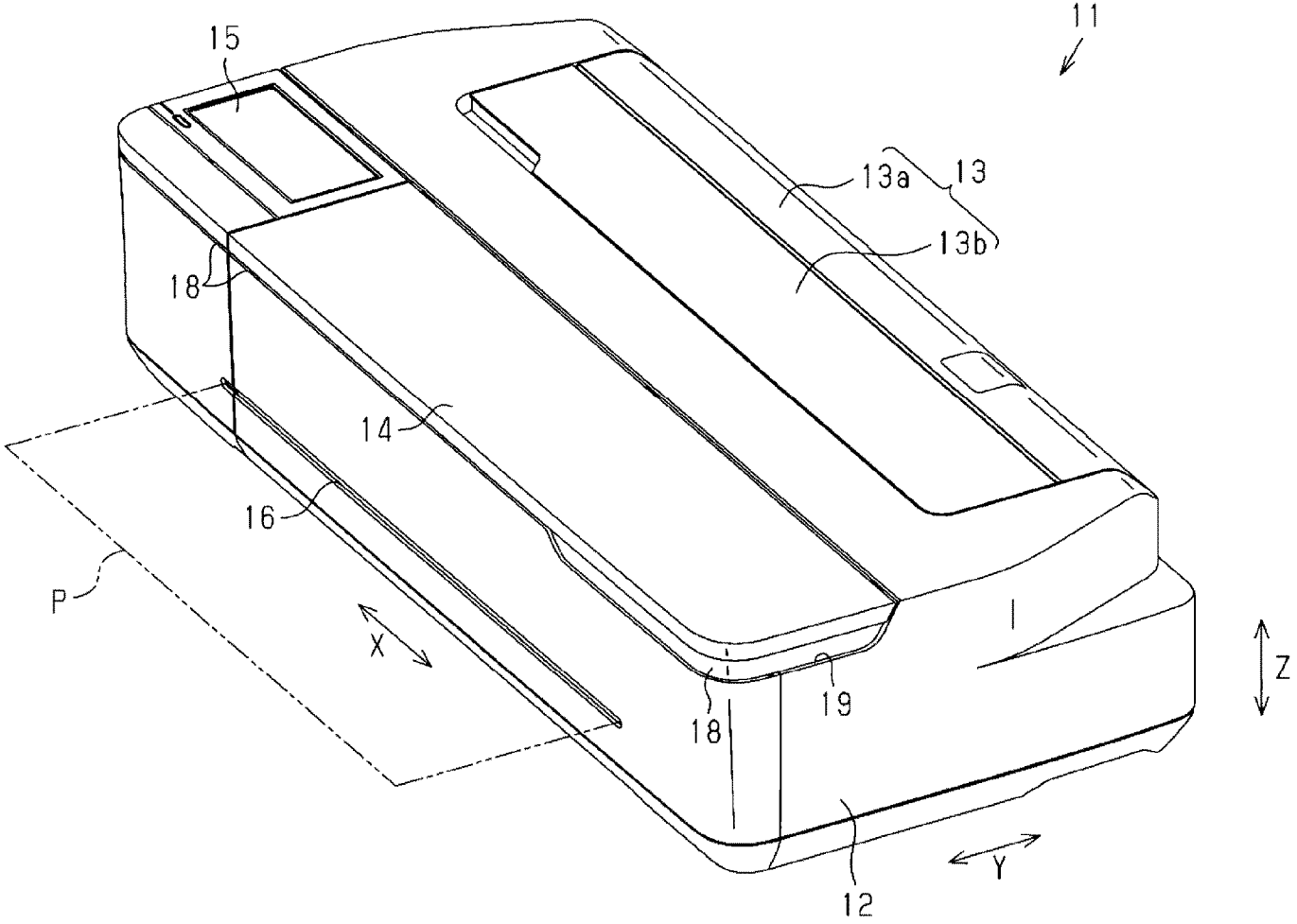
FIG. 1 is a perspective view of a printer according to one embodiment.

In the following description, assuming that a printer 11 illustrated in FIG. 1 is placed on a horizontal plane, a direction along a vertical direction is illustrated as a vertical direction Z, and a direction along a horizontal plane intersecting (orthogonal to) the vertical direction Z is illustrated as a width direction X and a depth direction Y. That is, the width direction X, the depth direction Y, and the vertical direction Z are different directions from each other and intersect each other (preferably orthogonal to). One end side in the depth direction Y is referred to as a front side, the other end side opposite to the one end side is referred to as a rear side, and one end side of the width direction X viewed from the front side may be referred to as a right side and the other end side may be referred to as a left side.

As illustrated in FIG. 1, the printer 11 is an example of a recording apparatus that records (prints) an image including a character, a figure, and the like by a recording unit with respect to a sheet P serving as an example of a recording medium, and is provided with a substantially rectangular parallelepiped casing 12. On an upper surface of the casing 12, a sheet feed cover 13 serving as an example of an opening/closing cover positioned on the rear side is provided so as to be movable between an open position where an inside of the casing 12 is exposed and a closed position where the inside of the casing 12 is not exposed. The sheet feed cover 13 includes a first cover 13*a* rotatably attached to the casing 12 by a shaft 13*c* (refer to FIG. 4) and a second cover 13*b* rotatably attached to the first cover 13*a* by a hinge 13*d* (refer to FIG. 2).

In addition, on the upper surface of the casing 12, a maintenance cover 14 is provided on the front side, and an operation panel 15 that performs various operations of the printer 11 is provided at a position adjacent to the maintenance cover 14 in the width direction X on the upper surface of the casing 12. The operation panel 15 of the embodiment is a touch panel, for example, and can display and input information. In addition, the operation panel 15 is provided so as to be rotatable around a rotation axis (not illustrated) provided on the front side, and is capable of changing a posture between an upright posture and a tilted posture.

A discharge port 16 through which the printed sheet P is discharged is provided on the front surface of the printer 11. In addition, a dent 18 is formed over the width direction X on the front surface of the printer 11. The lower end of the maintenance cover 14 is recessed so as to be positioned inside from the front surface and the right surface of the casing 12, so that a portion of the dent 18 is formed at a boundary between the maintenance cover 14 and the casing 12.

The casing 12 has a recessed portion 19 of which a height in the vertical direction Z is lower than the left end provided with the operation panel 15 and the center portion at a right end position in the width direction X. Therefore, a width of the dent 18 in the vertical direction Z is larger in the portion corresponding to the recessed portion 19 than that in the other portion.

In the printer 11 of the embodiment, images can be printed on a plurality of types of sheet P such as a roll sheet P3 unwound from a roll body RT (refer to FIG. 4), a second cut sheet P2 (refer to FIG. 2) cut in a rectangular shape, and a first cut sheet P1 (refer to FIG. 3) whose area is smaller than the second cut sheet P2.

Figure 4:
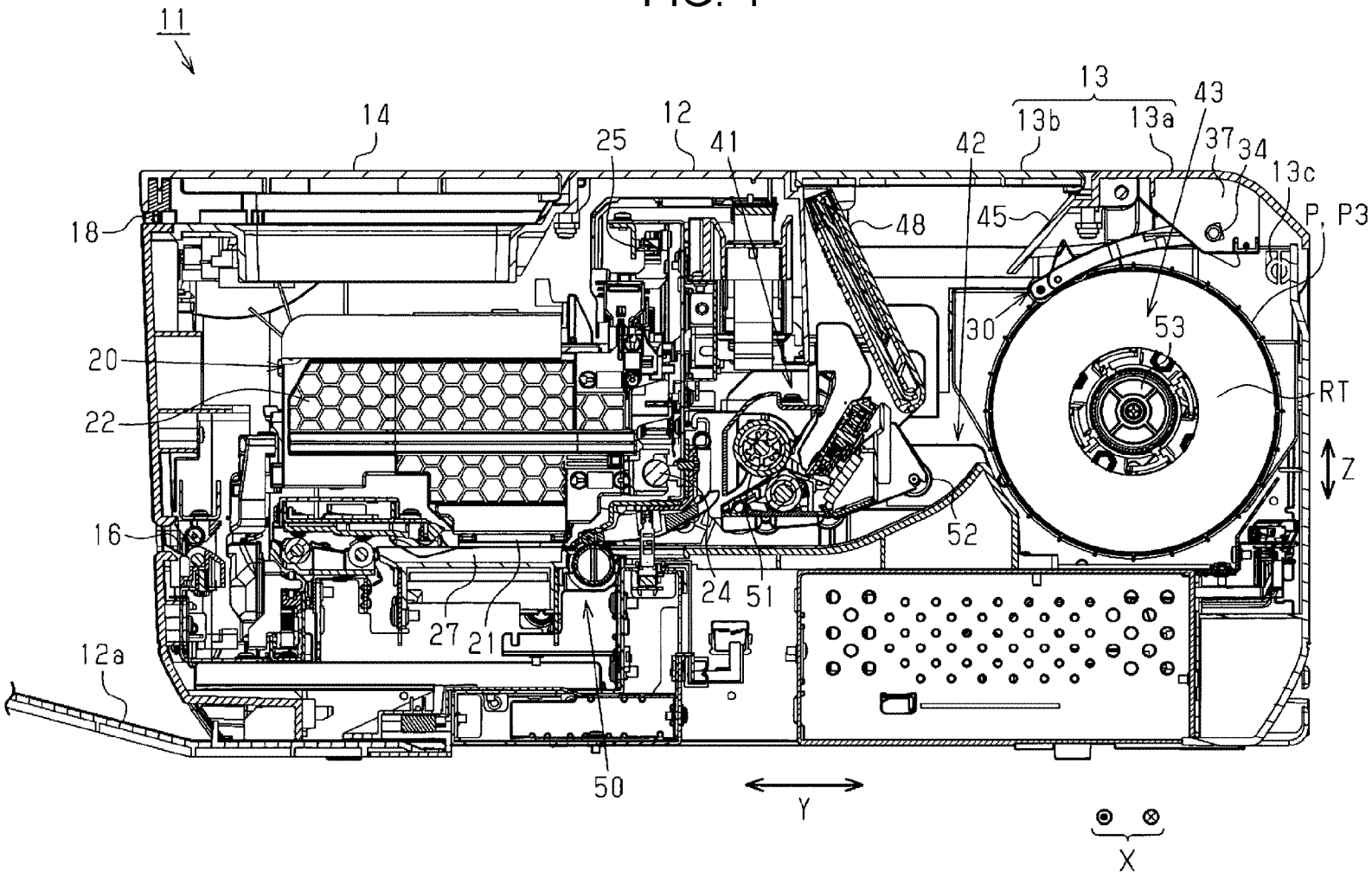
FIG. 4 is a cross-sectional view illustrating an internal structure of the printer.

That is, as illustrated in FIGS. 1 and 4, in the printer 11, the roll body RT on which the sheet P is wound in a roll is mounted on the rear side in the depth direction Y of the casing 12, and is accommodated in the casing 12 in a state where the upper portion is covered by the sheet feed cover 13. The sheet P (that is, roll sheet P3) unwound from the accommodated roll body RT is supplied to a printing unit 20 serving as an example of the recording unit provided in the printer 11.

Figure 2:
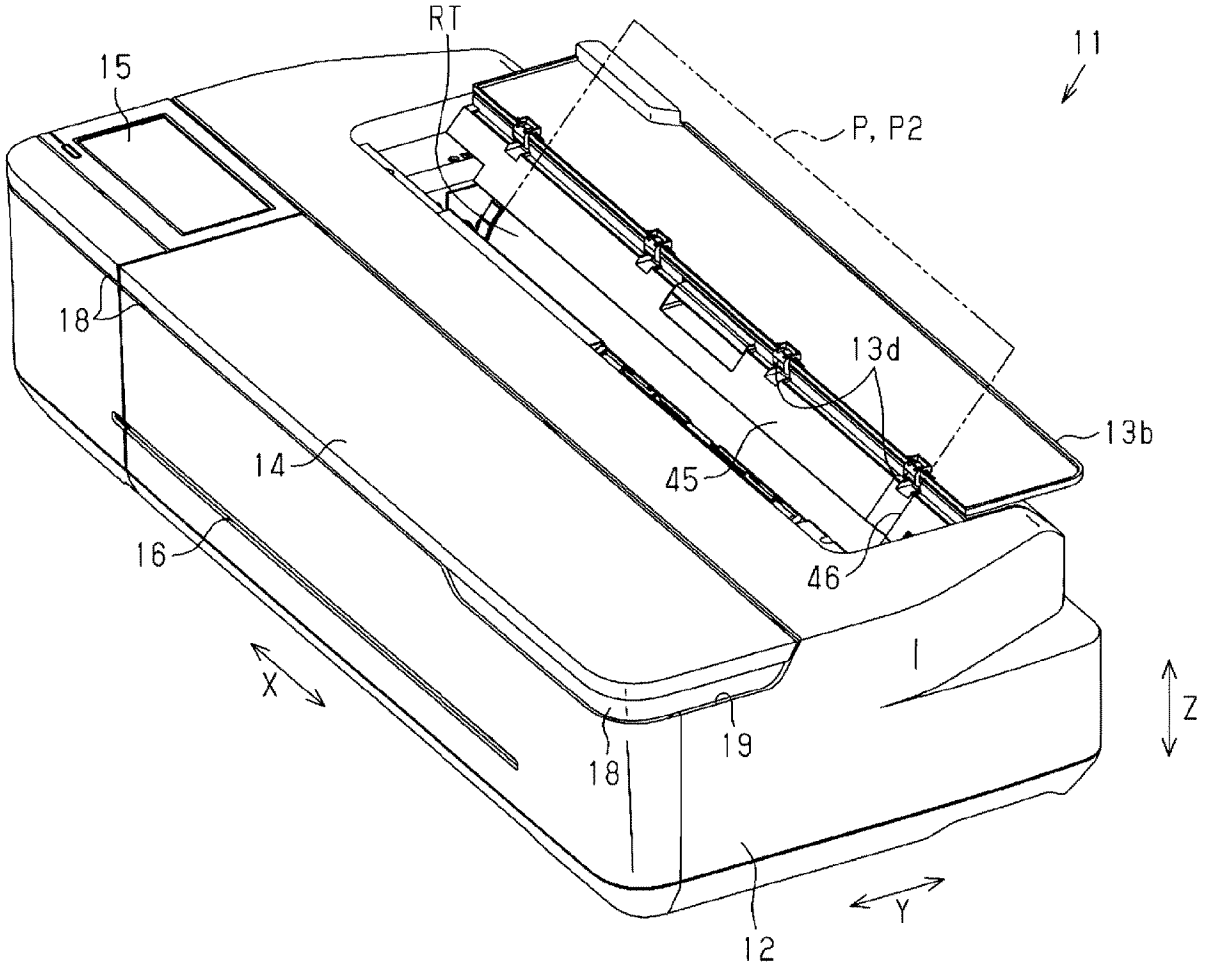
FIG. 2 is a perspective view of the printer in a state where a recording medium can be supplied by manual insertion.

In addition, as illustrated in FIG. 2, in the sheet feed cover 13 of the printer 11, a portion which is covered with the second cover 13*b* among the upper surface of the casing 12 is opened to form an opening portion in a second state where the first cover 13*a* is positioned at the closed position and the second cover 13*b* is positioned at the open position. It is possible to insert the second cut sheet P2 by manual insertion at a position in front of the roll body RT mounted on the casing 12 from the opening portion. The sheet feed cover 13 has a guide portion 45 that guides the insertion while supporting the second cut sheet P2 inserted from the opening portion at this time. Furthermore, the guide portion 45 has an edge guide 46 that guides the end of the second cut sheet P2. The second cut sheet P2 inserted from the opening portion is supplied to the printing unit 20.

Figure 3:
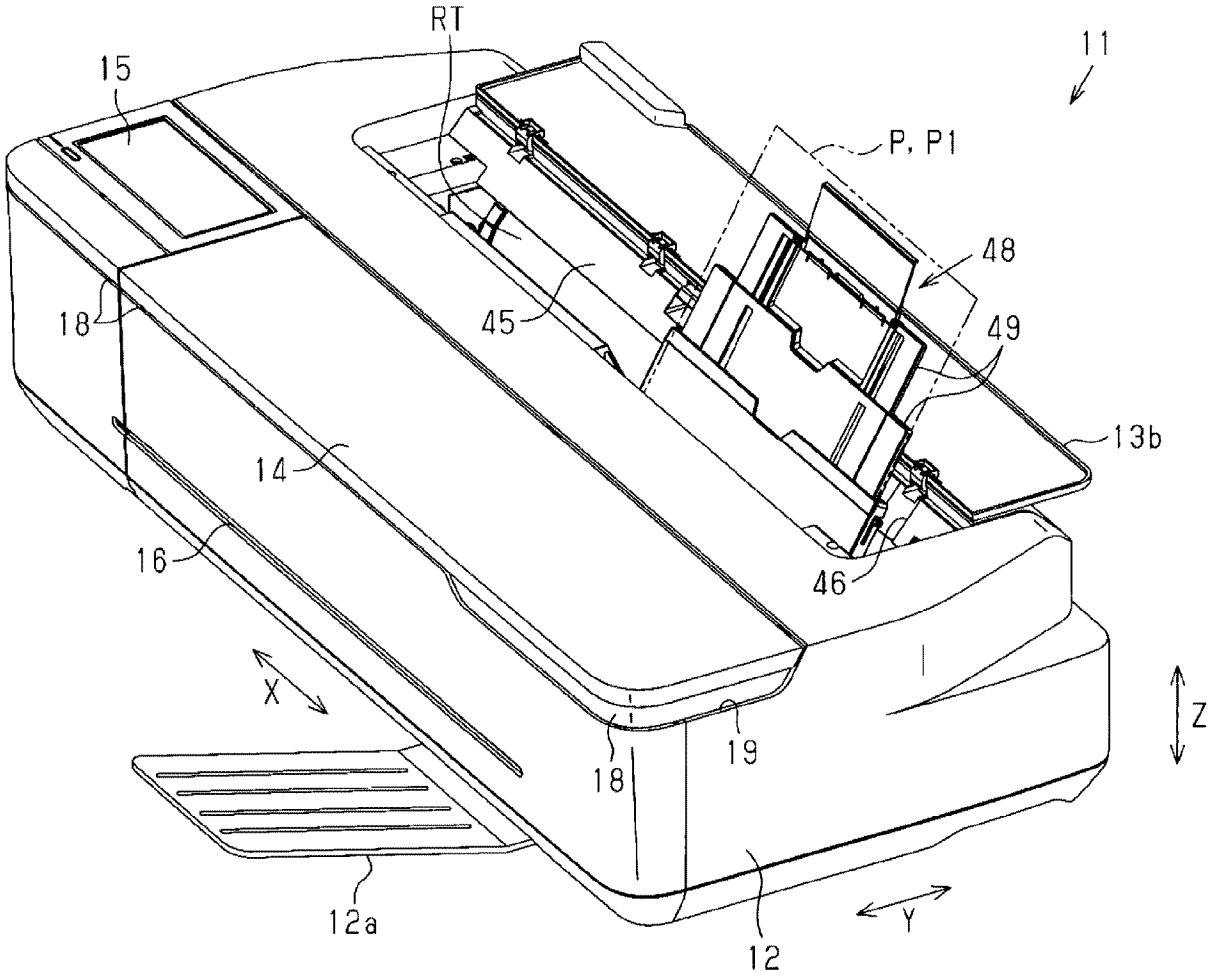
FIG. 3 is a perspective view of the printer in a state where the recording medium can be supplied from a sheet feed tray.

In addition, as illustrated in FIG. 3, in the second state where the second cover 13*b* is positioned at the open position, the printer 11 is provided with a sheet feed tray 48 which is extendable and contractible so as to be drawn out from the opening portion on the upper surface of the casing 12, and is rotatable so as to be in a rearward tilted posture fallen to the rear side. In a case where feeding the first cut sheet P1, the sheet feed tray 48 is drawn out from the opening portion and is in the rearward tilted posture fallen to the rear side.

Specifically, the sheet feed tray 48 is configured by combining a plurality of guide plates 49 having different sizes. With this configuration, the sheet feed tray 48 expands and contracts by drawing out a small size guide plate 49 from a large size guide plate 49 or accommodating the small size guide plate 49 in the large size guide plate 49. The sheet feed tray 48 can mount the first cut sheet P1 in a state where the guide plate 49 is drawn out and is in the rearward tilted posture. That is, the sheet feed tray 48 is an example of a medium mounted unit that can be mounted in a state where a plurality of first cut sheets P1 are stacked and the first cut sheet P1 stacked and mounted on the sheet feed tray 48 is supplied one by one to the printing unit 20.

In addition, as illustrated in FIG. 3, a mounted table 12*a* on which the first cut sheet P1 supplied from the sheet feed tray 48, printed by the printing unit 20, and discharged from the discharge port 16 is mounted is attached to the front side of the casing 12 by being inserted into the bottom of the casing 12 as necessary (refer to FIG. 4).

As illustrated in FIGS. 2 and 3, in the second state where the first cover 13*a* is positioned at the closed position and the second cover 13*b* is positioned at the open position, regardless of the expansion and contraction of the guide plate 49, the sheet feed tray 48 is in a forward tilted posture, so that the second cut sheet P2 can be fed to the printing unit 20. Furthermore, the sheet feed tray 48 is in the rearward tilted posture, so that the first cut sheet P1 can be fed to the printing unit 20.

As illustrated in FIG. 4, the printer 11 is provided with a first sheet feed unit 41 that supplies the first cut sheet P1 (sheet P), a second sheet feed unit 42 that supplies the second cut sheet P2 (sheet P), and a third sheet feed unit 43 that feeds the roll sheet P3 (sheet P) unwound from the roll body RT to the printing unit 20. In the embodiment, the first sheet feed unit 41, the second sheet feed unit 42, and the third sheet feed unit 43 function as a medium supply portion that supplies the sheet P to the printing unit 20.

The first sheet feed unit 41 is provided with a sheet feed roller 51 that feeds the uppermost first cut sheet P1 among the first cut sheet P1 mounted on the sheet feed tray 48 in a stacked state. In addition, the second sheet feed unit 42 is provided with a guide roller 52 that guides the second cut sheet P2 when the second cut sheet P2 set one by one on the guide portion 45 is supplied to the printing unit 20.

The third sheet feed unit 43 rotatably holds the roll body RT having a cylindrical shape, is provided with a sheet feed shaft 53 serving as an example of the cylindrical shaft of the roll body RT, unwinds the roll sheet P3 (sheet P) from the roll body RT by rotating the sheet feed shaft 53 in one direction (counterclockwise direction in FIG. 4), and supplies (feeds) the roll sheet P3 to the printing unit 20. The third sheet feed unit 43 is capable of feeding the roll sheet P3 to the printing unit 20 in a first state where the first cover 13*a* and the second cover 13*b* are in a closed position.

Figure 5:
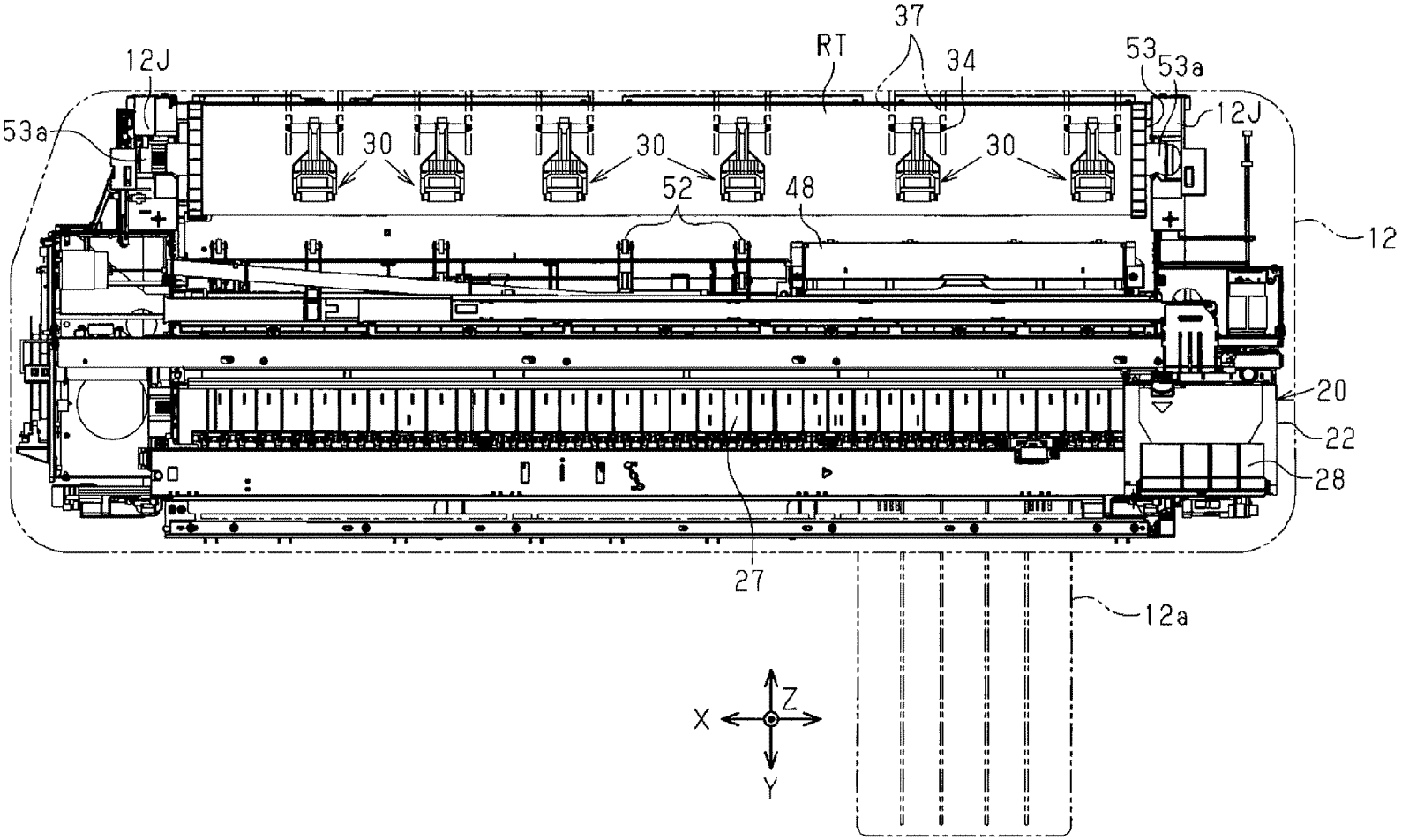
FIG. 5 is a plan view illustrating the internal structure of the printer.

As illustrated in FIG. 5, in the third sheet feed unit 43, in the roll body RT, shaft end portions 53*a* on both sides of the sheet feed shaft 53 around which the roll sheet P3 is wound are inserted from an upper side and mounted on a bearing portion 12J provided in the casing 12. A plurality of a pressing portions 30 that press the roll body RT mounted on the third sheet feed unit 43 are provided along the axial direction of the sheet feed shaft 53. In FIG. 5, the internal structure of the printer 11 is illustrated in a state where the casing 12 and the mounted table 12*a* are removed.

In each of the pressing portions 30, both ends of the shaft portion 34 formed on the side opposite to the side in contact with the roll body RT are respectively inserted into shaft holes provided in a pair of rib-like walls 37 (refer to FIG. 4) formed on the first cover 13*a*, and are swingable around the shaft portion 34. The roll body RT (specifically, roll sheet P3 wound in a roll on outermost periphery) is pressed by a biasing member (not illustrated) from the same upper side as the insertion direction at the time of mounting the roll body RT.

As illustrated in FIGS. 4 and 5, the printing unit 20 to which the sheet P is supplied has a discharge head 21 serving as an example of a recording head to records on the sheet P, and a carriage 22 serving as an example of a head moving portion which is provided with the discharge head 21 and is movable in a direction intersecting a transport direction. A support portion 27 supporting each the sheet P supplied from the first sheet feed unit 41, the second sheet feed unit 42, and the third sheet feed unit 43 is provided in the casing 12, and an image or the like is recorded (printed) by discharging a liquid such as ink from the discharge head 21 provided in the printing unit 20 on the sheet P supported by the support portion 27.

Specifically, the printer 11 has a main guide shaft 24 and a sub guide shaft 25 that guide the movement of the carriage 22 as illustrated in FIG. 4. The main guide shaft 24 and the sub guide shaft 25 are provided at the rear side of the carriage 22 along the width direction X (scanning direction). In addition, the sub guide shaft 25 is provided at a position higher than the main guide shaft 24. The carriage 22 is slidably fitted to the main guide shaft 24 from the front side and is slidably in contact with the plate-like sub guide shaft 25 from the rear side. The main guide shaft 24 and the sub guide shaft 25 are provided at intervals in the vertical direction Z, so that a tilt (for example, forward tilt) in a direction intersecting the vertical direction Z of the printing unit 20 (carriage 22) is suppressed.

In addition, in the embodiment, as illustrated in FIG. 5, in the carriage 22, at least one liquid container 28 (four in the embodiment) that store a liquid is detachably mounted. The printing unit 20 discharges the liquid supplied from the liquid container 28 from a plurality of nozzles (not illustrated) provided in the discharge head 21 and prints on the sheet P. In addition, in the printer 11, a maintenance portion (not illustrated) maintaining the discharge performance of the liquid from the printing unit 20 is provided at a home position (in the embodiment, as illustrated in FIG. 5, position at right end of width direction X in casing 12) where the sheet P and the printing unit 20 do not face each other.

As illustrated in FIG. 4, the printer 11 has a transport portion 50 having a plurality of roller pairs transporting the sheet P supplied from each sheet feed unit from the upstream side which is the side opposite to the discharge port 16 side with respect to the printing unit 20 toward the downstream side which is the discharge port 16 side.

In the embodiment, when the first cut sheet P1 supplied from the sheet feed tray 48 is transported to the printing unit 20, a skew removal mechanism that corrects a tilt of the first cut sheet P1 with respect to the transport direction and corrects the tilt in the normal orientation is provided. The skew removal mechanism is provided between a pair of transport rollers transporting the first cut sheet P1 to the printing unit 20 among the pair of rollers provided in the transport portion 50 and the first sheet feed unit 41.

Next, the configuration of the skew removal mechanism will be described.

Figure 6:
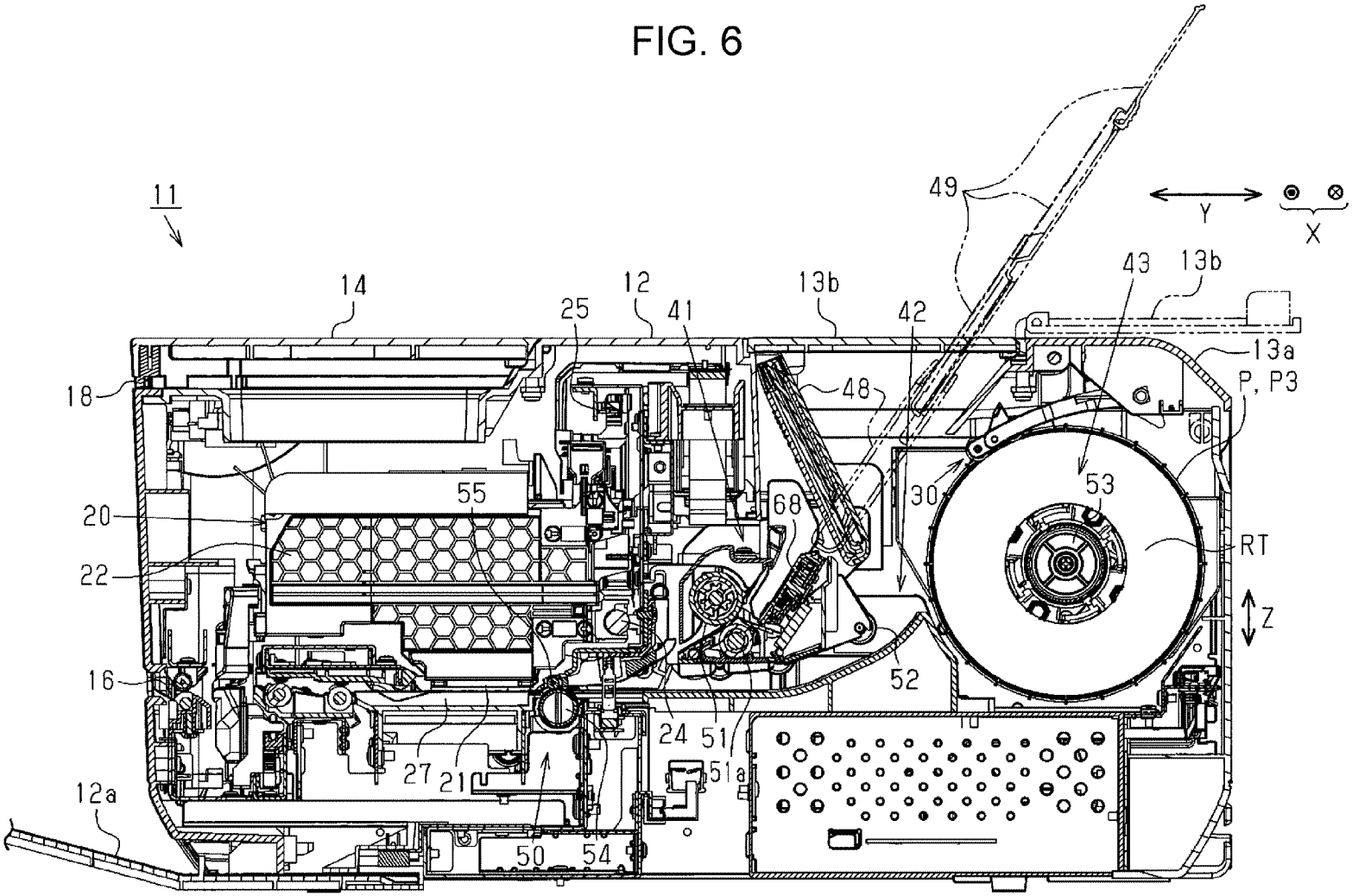
FIG. 6 is a cross-sectional view illustrating the internal structure of the printer in a state where the recording medium can be supplied from the sheet feed tray.

As illustrated in FIG. 6, the first sheet feed unit 41 transports (feeds) the first cut sheet P1 (not illustrated) mounted (stacked and mounted) on the sheet feed tray 48 drawn out from the opening portion on the upper surface of the casing 12, and of a state of being in the rearward tilted posture fallen to the rear side (state indicated by a two-dot chain line in FIG. 6) toward the printing unit 20 one by one by the sheet feed roller 51.

Specifically, the sheet feed roller 51 is a drive roller (first drive roller) which is rotationally driven in one direction by a motor (not illustrated) serving as an example of a drive portion provided in the casing 12. In the first cut sheet P1 mounted on the sheet feed tray 48, an edge of the sheet on the transport direction side is moved towards the sheet feed roller 51 by the hopper 68 provided on the lower side of the sheet feed tray 48 which is the transport direction of the first cut sheet P1 and comes into contact with the sheet feed roller 51. Due to the rotation of the sheet feed roller 51, the first cut sheet P1 with which the edge of the sheet contacts moves toward the printing unit 20. At this time, the separation roller 51*a* that applies a frictional force to the surface opposite to the contact surface of the sheet feed roller 51 with respect to the first cut sheet P1 to separate the first cut sheet P1 one by one is provided in the first sheet feed unit 41 so that the first cut sheet P1 moves toward the printing unit 20 one by one.

The first cut sheet P1 moved towards the printing unit 20 in the first sheet feed unit 41 is then held and transported by the transport roller pair provided in the transport portion 50. The transport roller pair includes the transport roller 54 which is a drive roller (second drive roller) which is rotationally driven in one direction by a motor (not illustrated) serving as an example of a drive portion provided in the casing 12, and a driven roller 55 that holds the sheet P with the transport roller 54 and rotates in accordance with the rotation of the transport roller 54.

That is, the printer 11 is provided with the sheet feed roller 51 serving as an example of the first drive roller transporting the first cut sheet P1 in the transport direction from the sheet feed tray 48 toward the printing unit 20. In addition, the transport roller 54 is provided that is an example of the second drive roller which is disposed on a downstream side from the sheet feed roller 51 in the transport direction, holds the first cut sheet P1 with the driven roller 55, and transports the first cut sheet P1 in the transport direction.

In the embodiment, a motor serving as an example of a drive portion driving the sheet feed roller 51 and a motor serving as an example of a driving portion driving the transport roller 54 are the same single motor (single drive portion). In the printer 11 of the embodiment, the rotation driving of the transport roller 54 is configured to be transmitted to the sheet feed roller 51, and the sheet feed roller 51 and the transport roller 54 are simultaneously rotatable by a driving force from the single motor. The configuration will be described with reference to the drawings.

Figure 7:
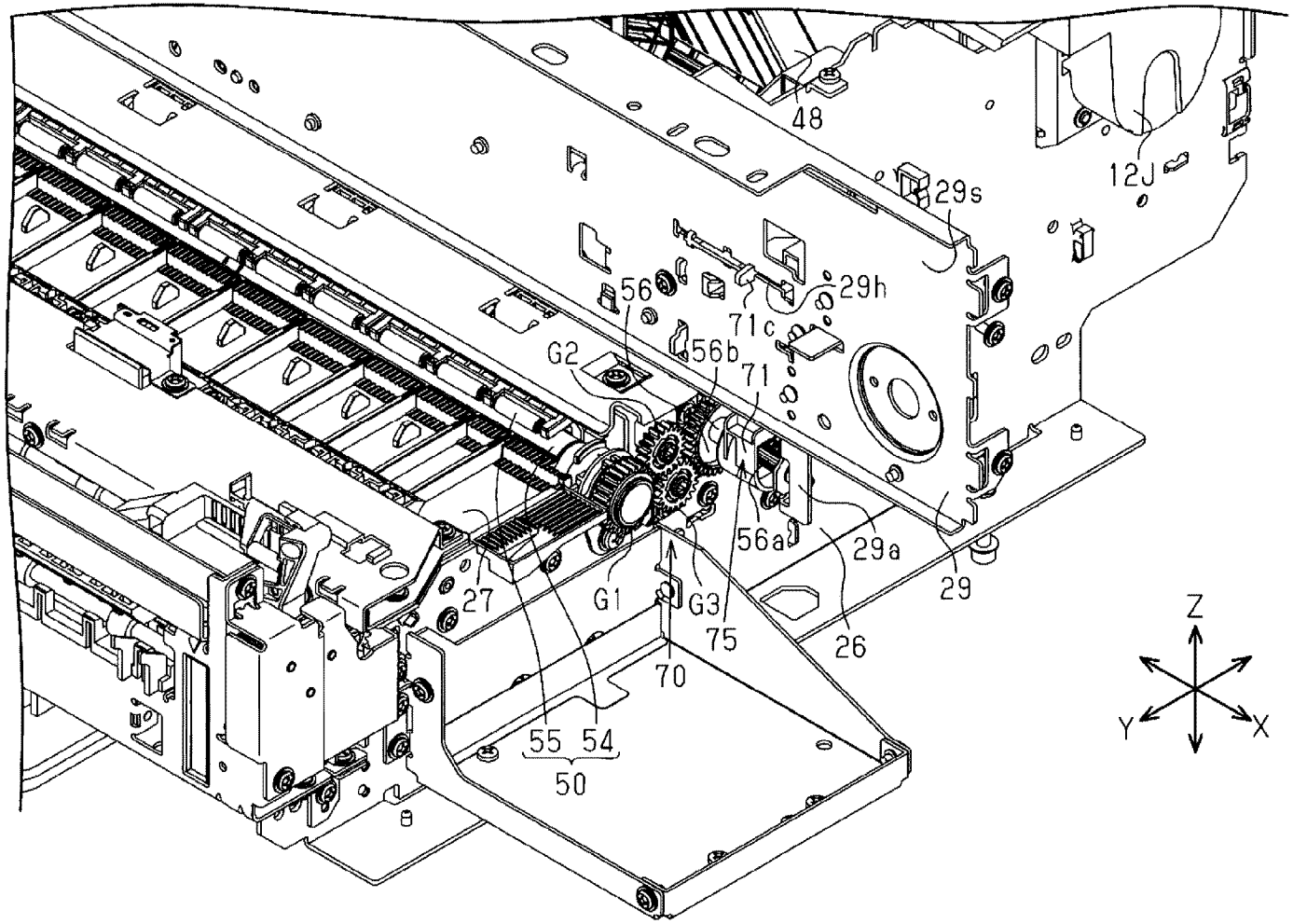
FIG. 7 is a perspective view illustrating a configuration relating to feeding of the recording medium from the sheet feed tray.
Figure 8:
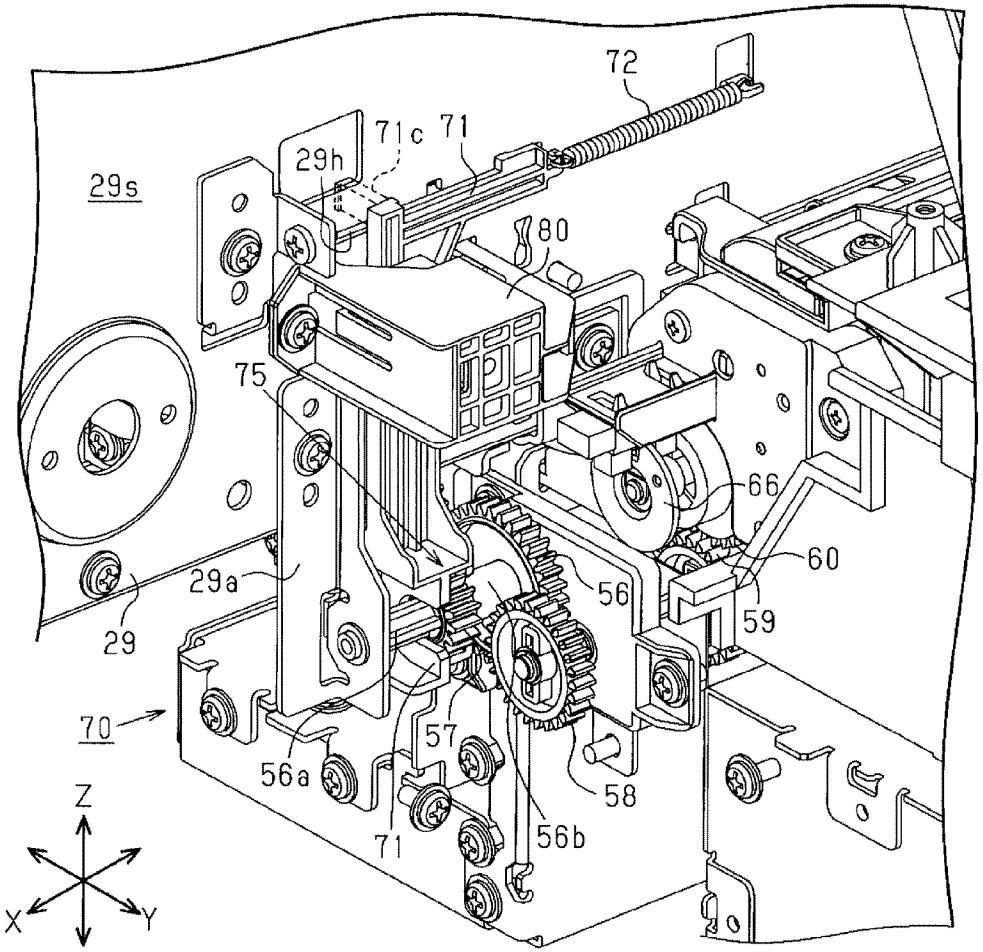
FIG. 8 is an enlarged perspective view illustrating a part of the configuration relating to feeding of the recording medium from the sheet feed tray.
Figure 9:
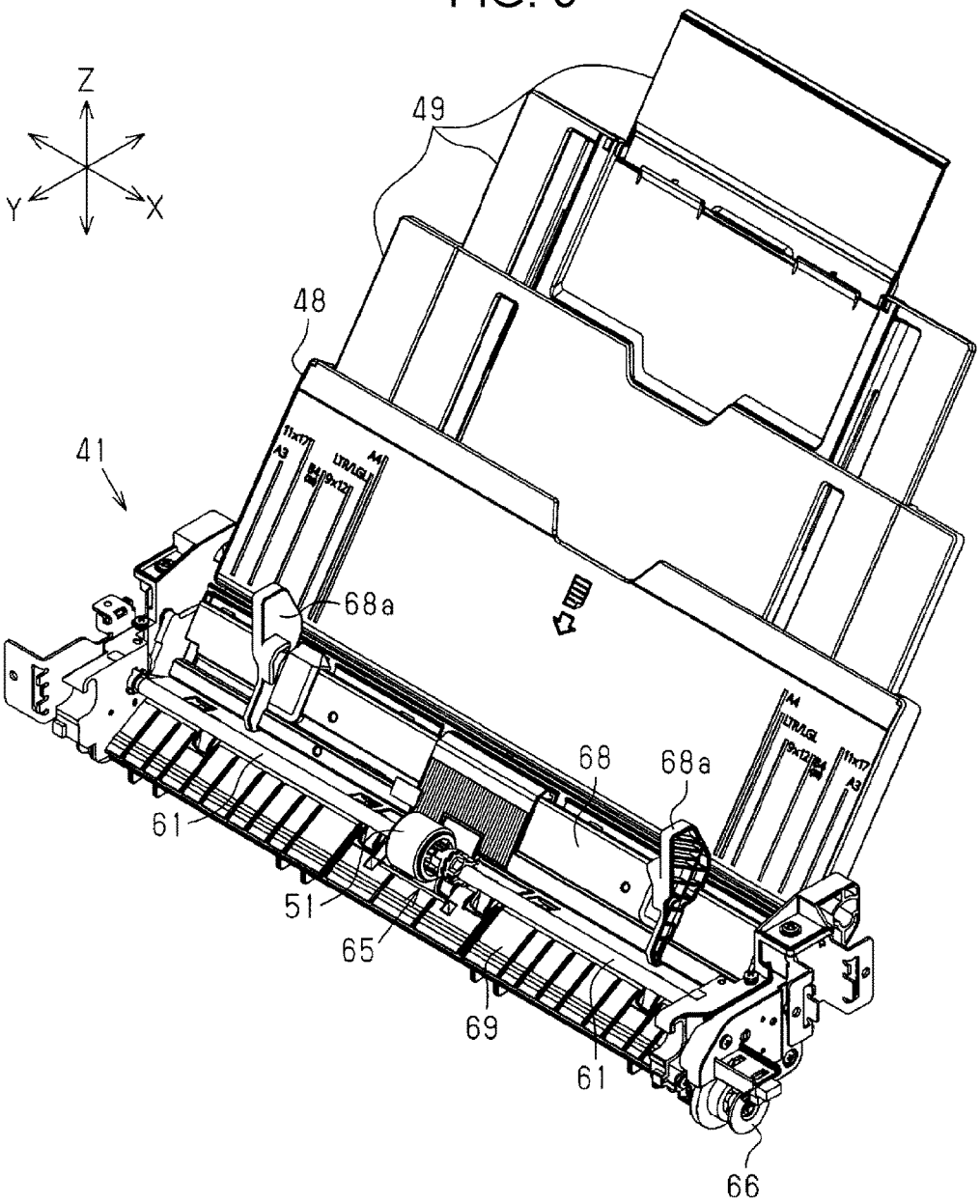
FIG. 9 is a perspective view illustrating a configuration relating to the sheet feed tray.

As illustrated in FIGS. 7, 8, and 9, the printer 11 of the embodiment is configured with a plurality of gears, and there is provided a driving force transmission unit 70 that transmits the rotation of the roller shaft of the transport roller 54 to a roller rotation shaft 61 to which the sheet feed roller 51 is attached. In addition, the driving force transmission unit 70 has a switching mechanism 75 that switches the driving force with respect to the sheet feed roller 51 (roller rotation shaft 61) between transmission and non-transmission by movement of the carriage 22. In FIG. 7, a portion of the right side of the frame structure of the printer 11 from which the casing 12 is removed is illustrated, and in FIG. 8, a frame side plate 26 on the right side in FIG. 7 is illustrated in an enlarged state of being removed. In addition, in FIG. 9, the structure related to the sheet feed tray 48 and the sheet feed roller 51 is illustrated.

As illustrated in FIGS. 7 and 8, the driving force transmission unit 70 has a gear 56 meshing with a gear G1 attached to the end of the roller shaft of the transport roller 54 via gears G2 and G3, and transmits the rotation of the transport roller 54 to the rotation of the gear 56. The gear 56 has a rotating shaft portion 56*a* having a cross-shaped cross section and the gear 57 which rotates together with the gear 56 in the rotating shaft portion 56*a* and is movable along the width direction X which is the axial direction of the rotating shaft portion 56*a* is attached. In addition, a coil spring 56*b* is attached to the rotating shaft portion 56*a* so as to bias the gear 57 in a direction away from the gear 56 in the width direction X.

The gear G1 (transport roller 54), the gears G2 and G3 are rotatably and pivotally supported in the frame side plate 26. In addition, one end of the rotating shaft portion 56*a* is rotatably held by the frame side plate 26, and the other end is rotatably held by a plate 29*a* fixed to the guide frame 29 extending in the width direction X to which the sub guide shaft 25 (refer to FIG. 6) is attached.

The gear 57 biased in a direction away from the gear 56 is positioned in the width direction X by a movement member 71 serving as a constituent member of the switching mechanism 75. That is, the movement member 71 is attached to the rear side in the depth direction Y of a main surface 29*s* of the guide frame 29, a portion thereof is a protrusion portion 71*c* protruding to the front side in the depth direction Y of the main surface 29*s* in a slit hole 29*h*, and is attached so as to be movable in the width direction X along the slit hole 29*h* with the main surface 29*s* interposed therebetween. The movement member 71 is attached to the other end of a tension spring 72 whose one end is fixed to the guide frame 29 and is in a state of being pulled from the right side to the left side in the width direction X by the tension spring 72.

The movement member 71 is adapted to change the position in the width direction X. In a state where the movement member 71 has moved to the left side in the width direction X (refer to FIG. 12), the gear 57 is meshed with the gear 58. A gear 59 is attached to the rotation shaft of the gear 58, and the rotation of the gear 57 is transmitted to the rotation of the gear 59 via the gear 58. The rotation of the gear 59 is transmitted to a gear 60 provided on the side of the first sheet feed unit 41.

As illustrated in FIG. 9, in the first sheet feed unit 41, the rotation of the gear 60 to which the rotation of the gear 59 is transmitted is transmitted to the roller rotation shaft 61 by a gear (not illustrated), so that the roller rotation shaft 61 rotates. Due to the rotation of the roller rotation shaft 61, the sheet feed roller 51 attached to the roller rotation shaft 61 rotates. That is, the driving force transmission unit 70 transmits the driving force of the motor driving the transport roller 54 to the roller rotation shaft 61 via the gears G1, G2, and G3 and the gears 56, 57, 58, 59, and 60, so that the sheet feed roller 51 and the transport roller 54 are easily driven simultaneously by the single motor.

Incidentally, in the embodiment, the first sheet feed unit 41 is provided with an encoder 66 that detects the rotation state (such as rotation speed and rotational speed) of the roller rotation shaft 61. In addition, in the first sheet feed unit 41, a guide member 68*a* that guides the width direction X of the first cut sheet P1 is attached to the hopper 68 positioned on the lower side of the sheet feed tray 48, which is a sheet feed direction of the first cut sheet P1 mounted on the sheet feed tray 48. Furthermore, a sheet guide plate 69 is provided on the lower side of the hopper 68, which is the sheet feed direction of the first cut sheet P1.

Furthermore, in the embodiment, in the first sheet feed unit 41, a one-way clutch mechanism 65 that transmits rotation in one direction on the side of the sheet feed roller 51 from the side of the roller rotation shaft 61 is provided between the roller rotation shaft 61 and the sheet feed roller 51.

Figure 10:
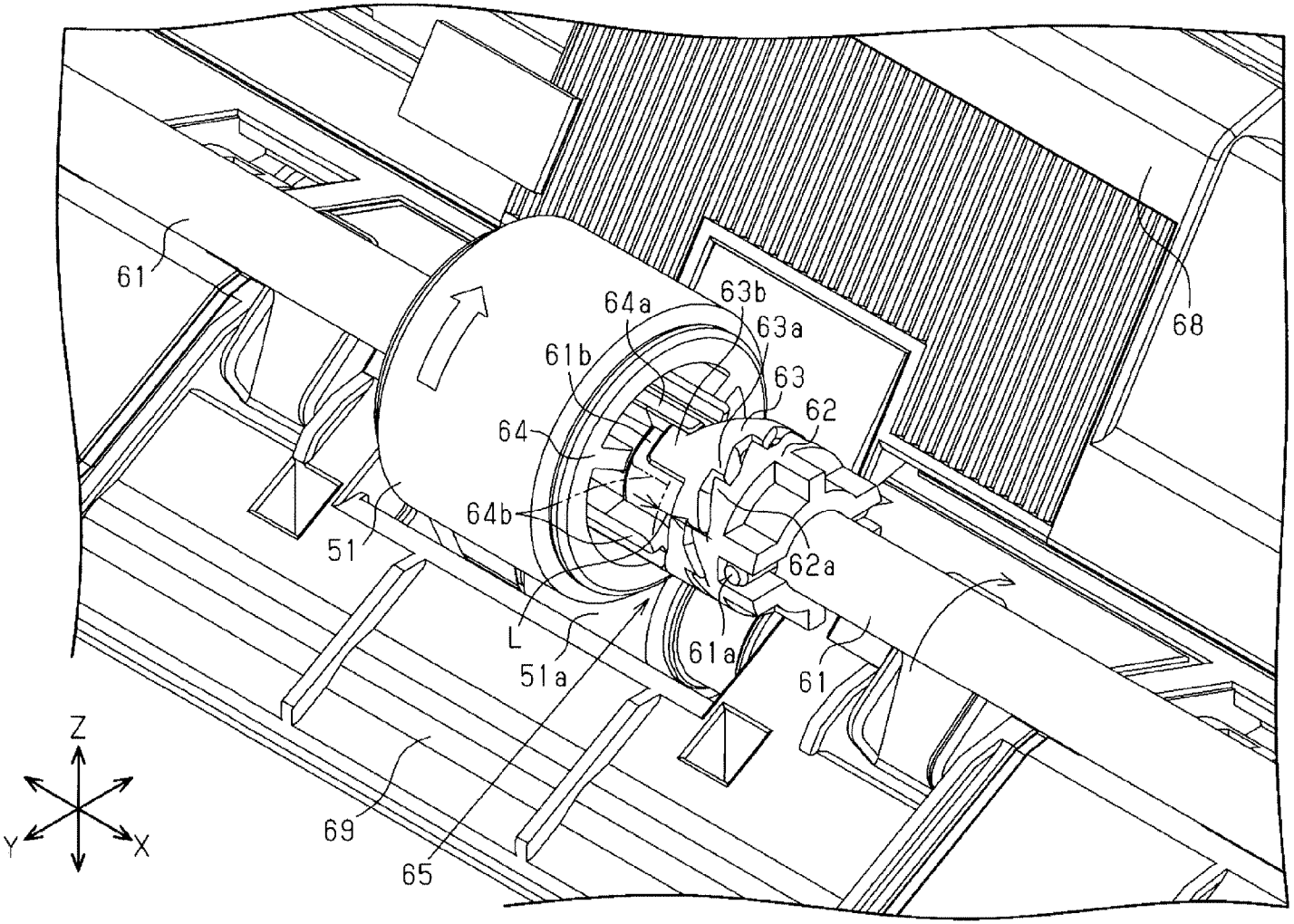
FIG. 10 is an enlarged perspective view illustrating a part of a configuration relating to a sheet feed roller of the sheet feed tray.

As illustrated in FIG. 10, the one-way clutch mechanism 65 includes a first clutch member 62 locked to the roller rotation shaft 61 by a pin 61*a* attached to the roller rotation shaft 61, and a second clutch member 63 which is rotatable with respect to the roller rotation shaft 61 and is attached so as to be movable in the axial direction (width direction X). The sheet feed roller 51 includes a cylindrical wheel portion 64 rotatably attached to the roller rotation shaft 61 in a state where the movement in the width direction X is restricted, and a contact portion which is in contact with the first cut sheet P1 is formed on the outer periphery of the cylindrical shape. A compression coil spring 61*b* is attached to the roller rotation shaft 61 between the wheel portion 64 and the second clutch member 63, and biases the second clutch member 63 so as to press the second clutch member 63 against the first clutch member 62 in the width direction X.

In the first clutch member 62, a plurality of triangular teeth 62*a* are formed on the side facing the second clutch member 63, and in the second clutch member 63, a plurality of triangular teeth 63*a* corresponding to the plurality of triangular teeth 62*a* in one-to-one correspondence formed in the first clutch member 62 are formed on the side facing the first clutch member 62. In a case where the roller rotation shaft 61 rotates at the time of sheet feeding as illustrated by a solid arrow in FIG. 10 by engaging surfaces of the triangular teeth 62*a* and the triangular teeth 63*a* with each other along the axial direction (width direction X) of the roller rotation shaft 61 in the width direction X, the rotation of the roller rotation shaft 61 is transmitted from the first clutch member 62 to the second clutch member 63.

In addition, in the second clutch member 63, a projection portion 63*b* is formed on the side facing the wheel portion 64. On the other hand, in the wheel portion 64, a rib 64*a* and a rib 64*b* in which wall portions are formed along the axial direction of the roller rotation shaft 61 are formed at intervals on the downstream side and the upstream side in the rotation direction at the time of sheet feeding of the roller rotation shaft 61 on the side facing the second clutch member 63. The projection portion 63*b* of the second clutch member 63 rotates together with the roller rotation shaft 61 and the rib 64*a* on the downstream side in the rotation direction engage with each other in the width direction X, so that the wheel portion 64 rotates with the rotation of the second clutch member 63. As a result, in a case where the roller rotation shaft 61 rotates at the time of sheet feeding as illustrated by the solid arrow in FIG. 10, the rotation of the roller rotation shaft 61 is further transmitted from the second clutch member 63 to the wheel portion 64, and the sheet feed roller 51 rotates.

On the other hand, when the roller rotation shaft 61 is not rotating, as illustrated by a hollow arrow in FIG. 10, in a case where the sheet feed roller 51 rotates in the rotation direction at the time of sheet feeding, the rotation of the sheet feed roller 51 idles without being transmitted to the roller rotation shaft 61 by the one-way clutch mechanism 65.

That is, the wheel portion 64 rotating with the rotation of the sheet feed roller 51 idles until the rib 64*b* on the upstream side in the rotation direction comes into contact with the projection portion 63*b*, as illustrated by a two-dot chain line in FIG. 10. Thereafter, the projection portion 63*b* engaging in the width direction X with the rib 64*b* of the wheel portion 64 rotates together with the rotation of the wheel portion 64, so that the second clutch member 63 rotates together with the rotation of the wheel portion 64.

At this time, each of the triangular teeth 63*a* formed in the second clutch member 63 has a slope in contact with a slope of each of the triangular teeth 62*a* formed in the first clutch member 62. Therefore, when the second clutch member 63 further rotates together with the wheel portion 64, since the slope of the triangular teeth 63*a* in contact with the triangular teeth 62*a* moves along the slope of the triangular teeth 62*a*, the second clutch member 63 is moved away from the first clutch member 62 in the width direction X. At this time, a gap L is provided between the second clutch member 63 and the rib 64*b* in the width direction X. It is necessary for the gap L to have a length for allowing the triangular teeth 62*a* and the triangular teeth 63*a* to move over the slopes of each other and to get over the slopes, and it is preferable that the gap L be equal to or longer than the length in the width direction X of the triangular teeth 62*a* or the triangular teeth 63*a*. In the gap L, the second clutch member 63 moves in the width direction X against the biasing force of the compression coil spring 61*b*, so that the triangular teeth 62*a* and the triangular teeth 63*a* disengage from each other in the axial direction (width direction X) of the roller rotation shaft 61, and the second clutch member 63 idles without rotating the first clutch member 62. As a result, in a case where the sheet feed roller 51 rotates in the rotation direction at the time of sheet feeding as illustrated by the hollow arrow in FIG. 10, the sheet feed roller 51 idles without the rotation being transmitted to the roller rotation shaft 61 by the one-way clutch mechanism 65.

Next, the configuration of the switching mechanism 75 provided in the driving force transmission unit 70 will be described.

Figure 11:
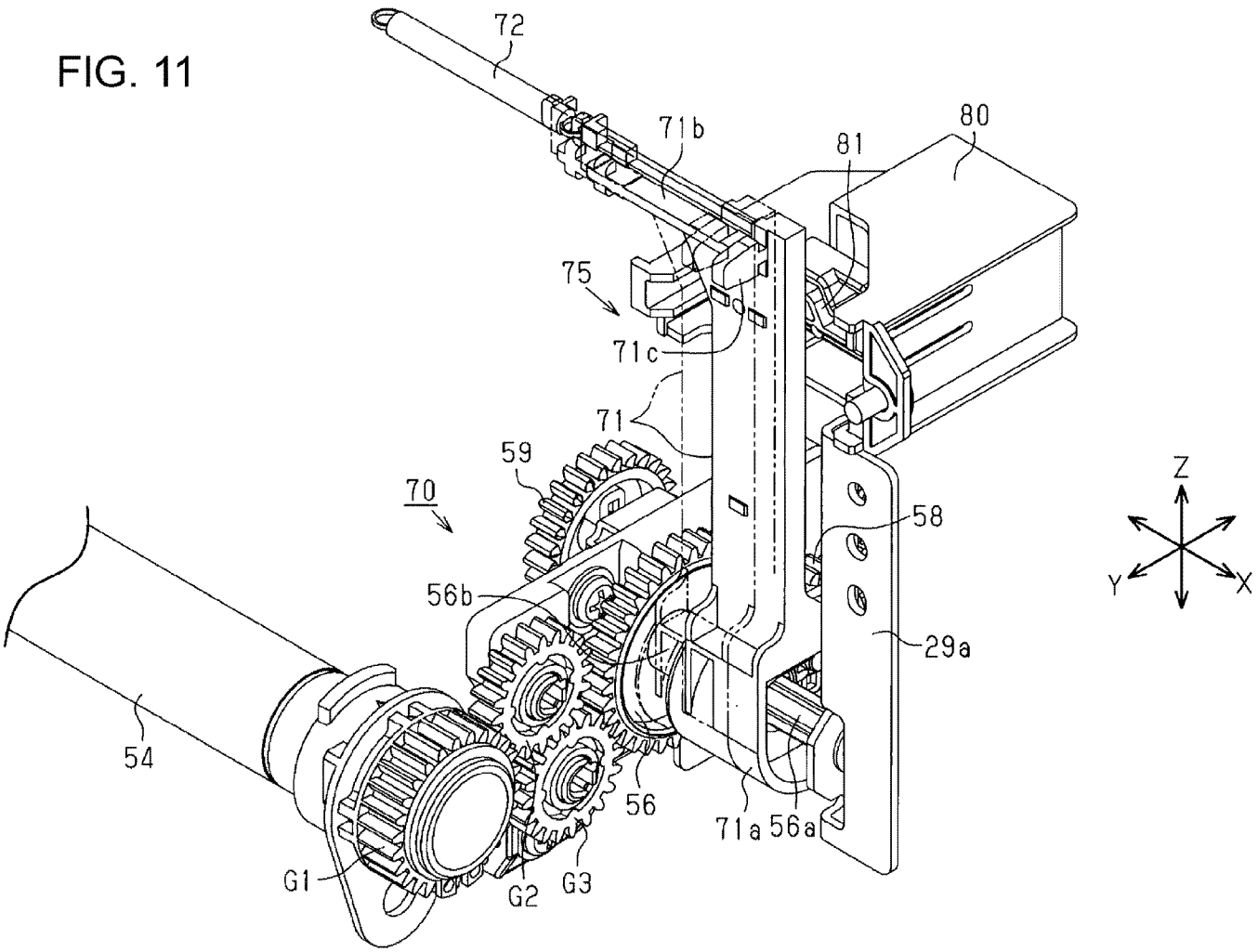
FIG. 11 is a perspective view illustrating a switching mechanism that transmits driving force to the sheet feed roller.
Figure 12:
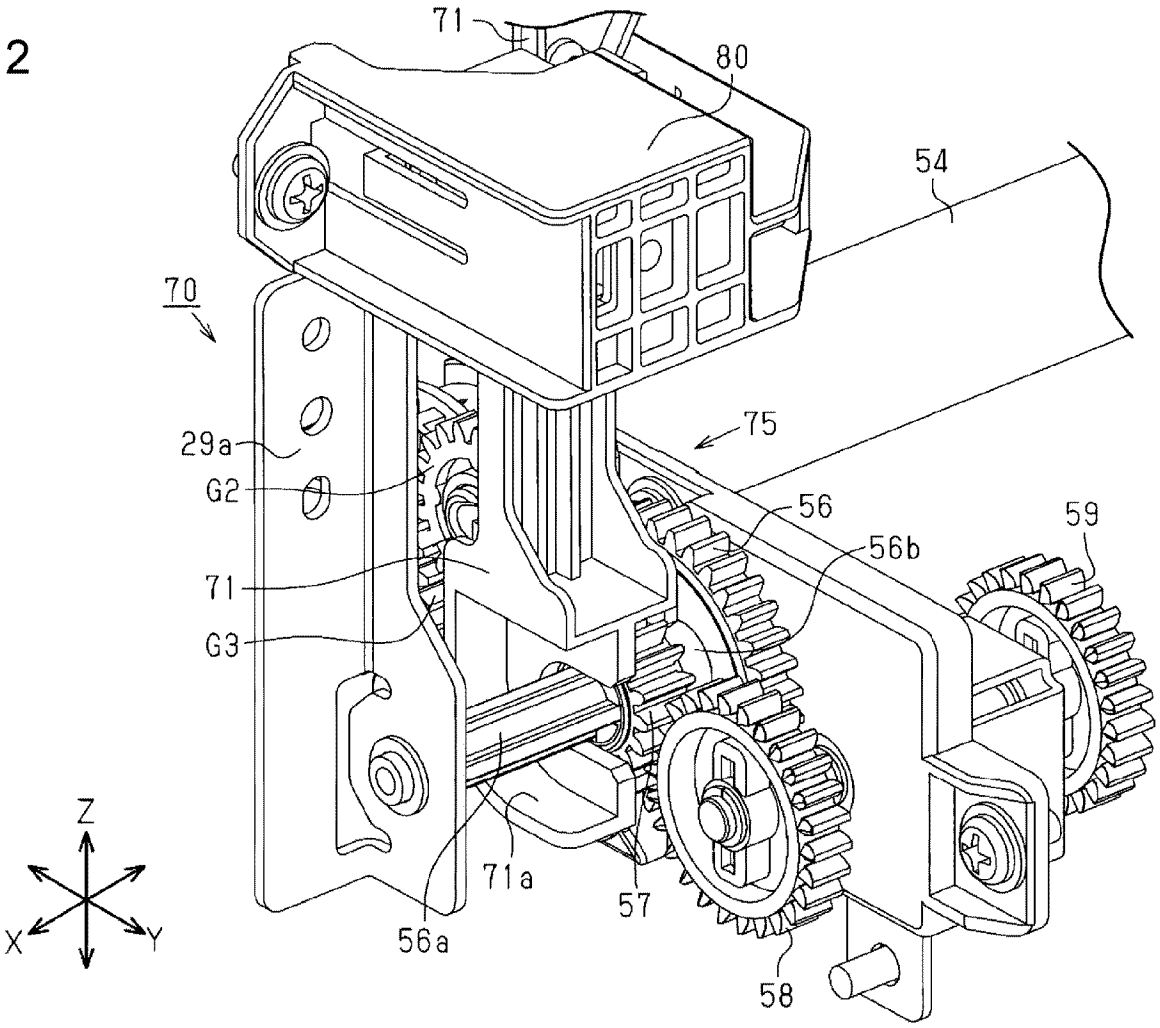
FIG. 12 is a perspective view illustrating a state where driving force is transmitted to the sheet feed roller in the switching mechanism.
Figure 13:
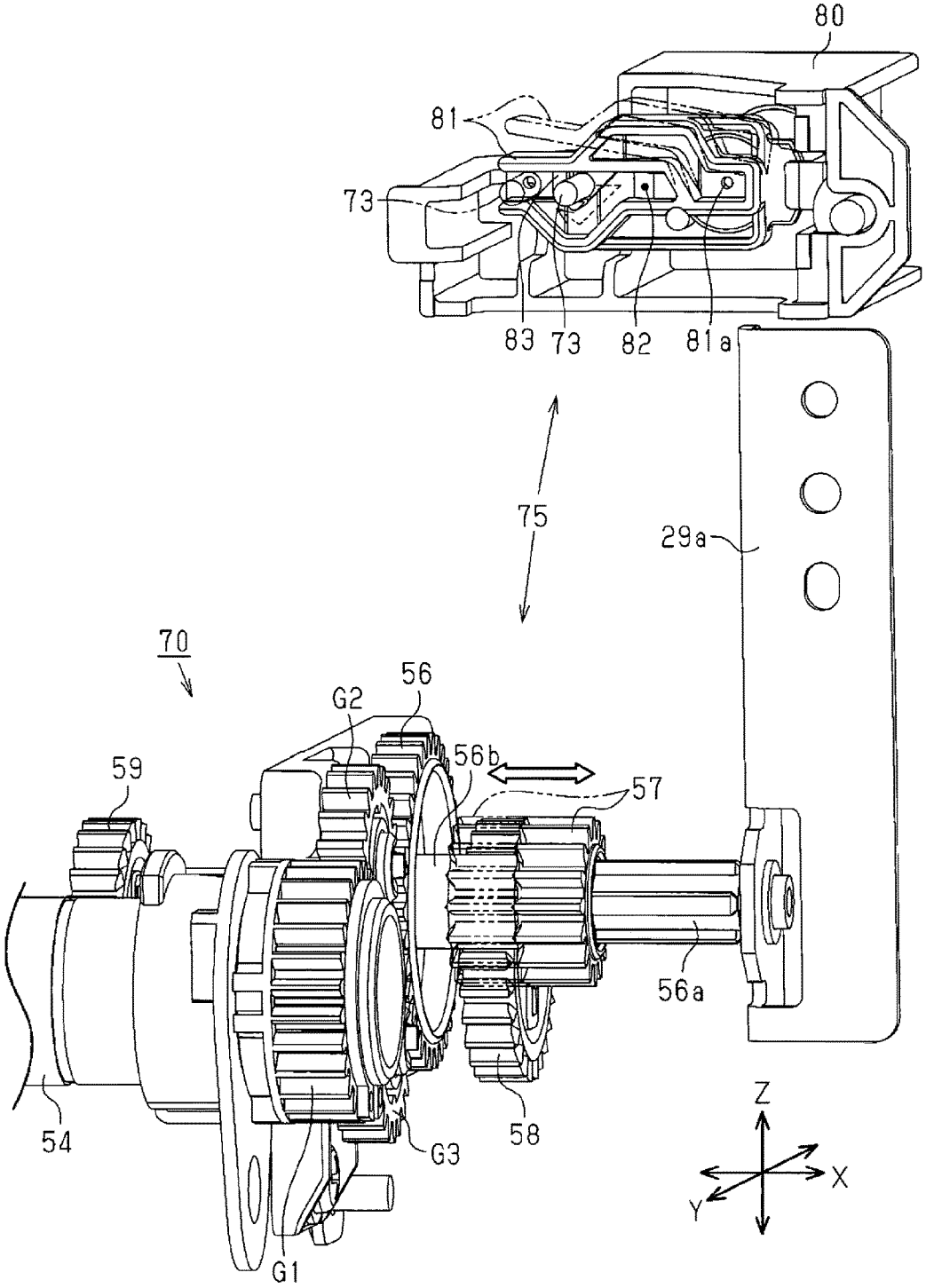
FIG. 13 is a perspective view illustrating a gear train constituting the switching mechanism and a part of a cam mechanism.

As illustrated in FIGS. 11, 12, and 13, the switching mechanism 75 is provided with the movement member 71 and a cam structure 81. The movement member 71 has a longitudinal direction in the vertical direction Z, and an upper portion 71*b* thereof has a shape that is substantially L-shaped as viewed in the depth direction Y extending to the left side in the width direction X. The cam structure 81 has a cam groove 82 in which a cam pin 73 provided on the movement member 71 slides, and is accommodated in a cam case 80 fixed to the guide frame 29. In FIGS. 11 and 12, the guide frame 29 and a frame side plate 26 are illustrated in a removed state. In addition, in FIG. 13, in addition to the guide frame 29 and the frame side plate 26, the movement member 71 is illustrated in a removed state.

The movement member 71 is a contact portion where the carriage 22 in which the protrusion portion 71*c* moves the front side in the depth direction Y of the main surface 29*s* (refer to FIG. 7) of the guide frame 29 from the left to the right in the upper portion 71*b*, contacts from the left side in the width direction X. In addition, the movement member 71 is normally biased to the left side of the width direction X by the tension spring 72. Therefore, in FIG. 11, the movement member 71 moves to the right side along the width direction X together with the carriage 22 after the carriage 22 (not illustrated) moving toward the right side of the width direction X comes into contact with the protrusion portion 71*c* from the left side. In a case where the carriage 22 moves toward the left side in the width direction X in a state of being in contact with the protrusion portion 71*c* or in a case where the carriage 22 is not in contact with the protrusion portion 71*c*, the movement member 71 moves to the left side in the width direction X by the tension spring 72.

In addition, the movement member 71 holds the gear 57 capable of moving the rotating shaft portion 56*a* of the gear 56 so as to be movable along the axis of the rotating shaft portion 56*a* by interposing the gear 57 from both sides of the width direction X at the lower portion 71*a* opposite to the protrusion portion 71*c* with the carriage 22. Therefore, the gear 57 held at the lower portion 71*a* of the movement member 71 moves along the axial direction (width direction X) of the rotating shaft portion 56*a* with the movement of the movement member 71 in the width direction X.

In the embodiment, in a case where the position of the movement member 71 in the width direction X is in the position illustrated by the solid line in FIG. 11, the gear 57 is not meshed with the gear 58 (refer to FIG. 8), and the switching mechanism 75 is in a non-transmission state where the rotation is not transmitted between the gear 57 and the gear 58. Therefore, for example, in a case where the transport roller 54 is rotationally driven, the rotation is not transmitted to the roller rotation shaft 61, so that the sheet feed roller 51 is not rotationally driven.

On the other hand, in a case where the position of the movement member 71 in the width direction X is in the position illustrated by a two-dot chain line in FIG. 11, as illustrated in FIG. 12, the gear 57 is meshed with the gear 58, and the switching mechanism 75 is in a transmission state where the rotation is transmitted between the gear 57 and the gear 58. Therefore, for example, in a case where the transport roller 54 is rotationally driven, the rotation is transmitted to the roller rotation shaft 61, so that the sheet feed roller 51 is rotationally and simultaneously driven.

In the embodiment, movement of the movement member 71 in the width direction X is performed using the movement of the movement member 71 to the right by the carriage 22 and the movement of the movement member 71 to the left by the tension spring 72. The position of the movement member 71 in the width direction X is positioned by the cam pin 73 provided in the movement member 71 and a cam mechanism including the cam groove 82 formed in the cam structure 81.

That is, as illustrated in FIG. 13, in the cam groove 82 provided in the cam structure 81, the bottom portion of the groove is formed on predetermined uneven shapes along the width direction X. In the cam groove 82, the cam pin 73 engages with a projecting portion 83 formed on the bottom surface as an inclined surface rising upward from the left direction to the right direction, in the depth direction Y as illustrated by the solid line in FIG. 13, so that the movement member 71 (not illustrated) is a position where the movement in the left direction in the width direction X is restricted. In the embodiment, this position is a non-transmission position of the driving force where the gear 57 does not mesh with the gear 58 as illustrated by the solid line in FIG. 13.

The carriage 22 moves to the right side in the width direction X in a state where the carriage 22 is in contact with the protrusion portion 71*c* with respect to the movement member 71 in this non-transmission position, the movement member 71 is moved to the right side in the width direction X by a predetermined amount. Thereafter, the carriage 22 moves to the left side in the width direction X so as to separate from the protrusion portion 71*c*, so that the movement member 71 moves to the right side in the width direction X by the tension spring 72. At this time, the cam pin 73 moves the cam groove 82 formed on the lower side of the projecting portion 83 so as to bypass the projecting portion 83 as illustrated by broken line arrows in FIG. 13, and moves to the position of the left end of the cam groove 82 where movement of the movement member 71 to the right side in the width direction X is restricted as illustrated by a two-dot chain line in FIG. 13.

In the embodiment, the cam pin 73 is positioned at the left end of the cam groove 82 as described above, so that the gear 57 meshes with the gear 58 as illustrated by the two-dot chain line in FIG. 13. That is, this position is the transmission position of the driving force where the gear 57 meshes with the gear 58.

When the cam pin 73 moves to the left end position of the cam groove 82, the cam structure 81 is lifted to the position of the cam pin 73 in the vertical direction Z. In the embodiment, the cam structure 81 is provided with a rotating shaft portion 81*a* whose axis is the depth direction Y at the right end portion, and the cam structure 81 lifted up to the position of the cam pin 73 rotates (swings) around the rotating shaft portion 81*a* as illustrated by the two-dot chain line in FIG. 13.

The carriage 22 moves to the right side in the width direction X in a state where the carriage 22 is in contact with the protrusion portion 71*c* with respect to the movement member 71 in the transmission position, so that the cam pin 73 that has moved through the cam groove 82 again engages with the projecting portion 83 in the depth direction Y, and is in the non-transmission position of the driving force where the movement to the left direction in the width direction X is restricted. That is, the cam pin 73 moves between the transmission position and the non-transmission position of the driving force by the movement in the right direction by the carriage 22 and the movement in the left direction by the tension spring 72, and the movement member 71 moves (reciprocates) between a position where the gear 57 meshes with the gear 58 and a position where the gear 57 does not mesh with the gear 58 as illustrated by a hollow double-headed arrow in FIG. 13.

The gear 57 is easily moved from a position where the gear 57 meshes with the gear 58 to a position where the gear 57 does not mesh with the gear 58 by the coil spring 56*b* attached to the rotating shaft portion 56*a* that biases the gear 57 in a direction away from the gear 56.

Next, skew removal of the sheet P serving as an operation of the embodiment will be described.

Since the printer 11 according to the embodiment has three sheet feed units of the first sheet feed unit 41, the second sheet feed unit 42, and the third sheet feed unit 43 that can feed the sheet P to the printing unit 20, by reducing the occupied space of the sheet feed units, the increase in the size of the printer 11 is suppressed. That is, in the first sheet feed unit 41, an increase in the number of motors is suppressed by driving the sheet feed roller 51 with a motor driving the transport roller 54. In addition, the distance from the sheet feed roller 51 to the transport roller 54 is shortened to suppress an increase in the occupied space of the first sheet feed unit 41. In the embodiment, the skew removal is performed so that the sheet P (first cut sheet P1) fed from the first sheet feed unit 41 configured as described above is transported to the printing unit 20 in the normal orientation.

Figure 14:
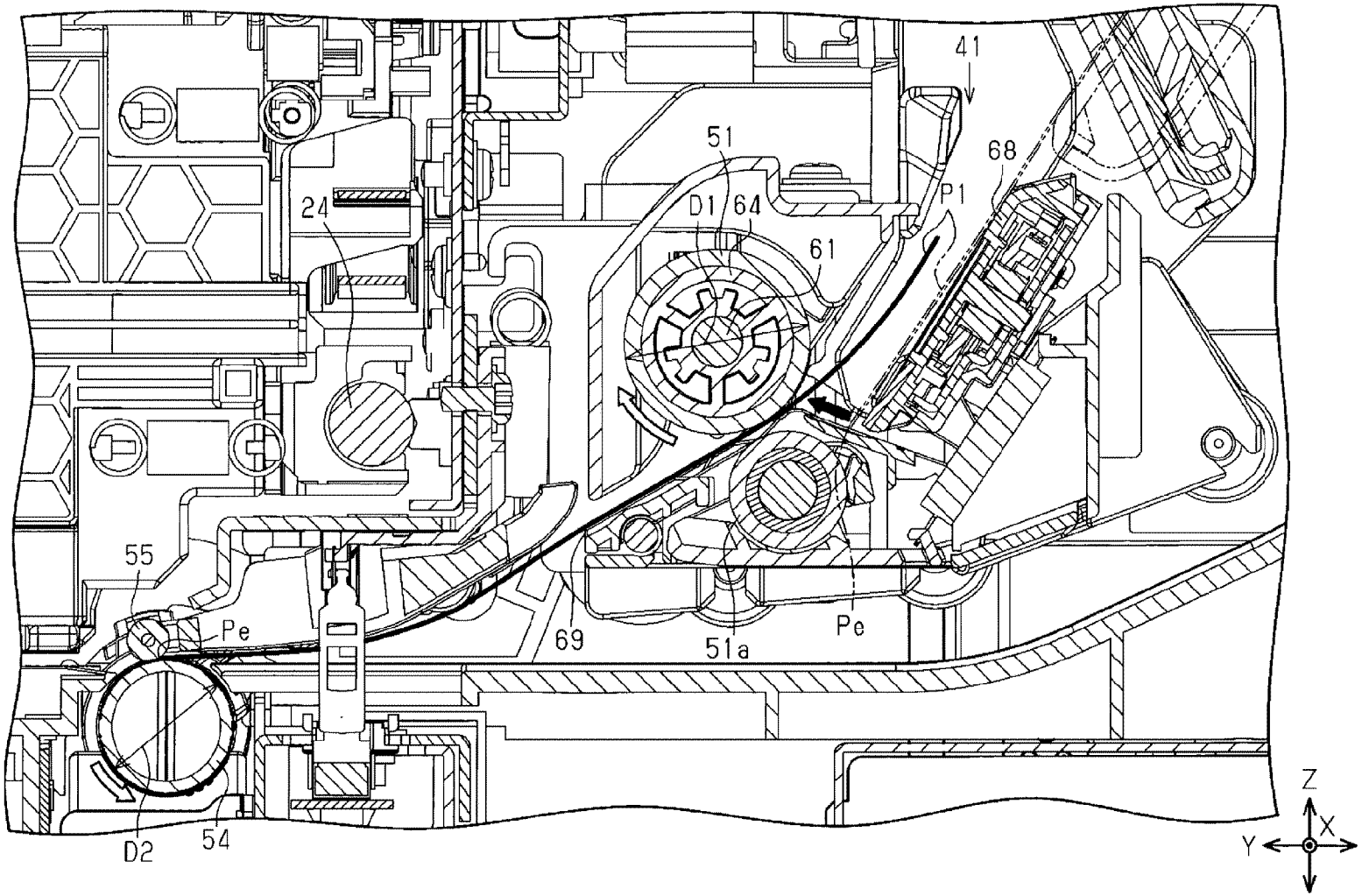
FIG. 14 is a partially enlarged sectional view of the printer illustrating the sheet feed roller and a transport roller.

As illustrated in FIG. 14, in the first sheet feed unit 41, the hopper 68 moves so that the hopper 68 approaches the sheet feed roller 51 as illustrated by a black arrow in FIG. 14, so that the sheet leading edge Pe of the first cut sheet P1 (illustrated by two-dot chain line in FIG. 14) mounted on the sheet feed tray 48 comes into contact with the sheet feed roller 51. The first cut sheet P1 with which the sheet leading edge Pe is in contact is transported to the transport roller 54 while being guided by the sheet guide plate 69 by the rotation of the sheet feed roller 51 rotating together with the transport roller 54, as illustrated in the hollow arrow in FIG. 14.

Therefore, here, in the switching mechanism 75 of the driving force transmission unit 70, the movement member 71 is in the transmission position of the driving force where the gear 57 meshes with the gear 58. As a matter of course, in the switching mechanism 75, in a case where the movement member 71 is in the non-transmission position of the driving force with which the gear 57 and the gear 58 do not mesh, the carriage 22 is moved to the right side in the width direction X before printing starts with the printing unit 20, and the movement member 71 is moved to the transmission position of the driving force where the gear 57 meshes with the gear 58 in the switching mechanism 75. That is, the driving force transmission unit 70 switches the driving force with respect to the sheet feed roller 51 from non-transmission to transmission by the movement of the carriage 22.

In the embodiment, as illustrated by a solid line in FIG. 14, at the time when the sheet feed roller 51 rotated two times from the start of transport by the sheet feed roller 51, the first cut sheet P1 moves to a position where the sheet leading edge Pe on the downstream side of the transport direction is held between the transport roller 54 and the driven roller 55. The rotation (two rotations) of the sheet feed roller 51 is detected by an encoder 66.

At the time when the sheet leading edge Pe is held between the transport roller 54 and the driven roller 55, the first cut sheet P1 moved to the position where the sheet leading edge Pe is held between the transport roller 54 and the driven roller 55 by the rotation of the sheet feed roller 51 is transported in the transport direction with a speed (peripheral speed) of the roller surface in the transport roller 54 as a transport speed. At this time, a sheet trailing edge portion on the side opposite to the sheet leading edge Pe of the first cut sheet P1 is transported to the transport direction by the sheet feed roller 51 with a speed (peripheral speed) of the roller surface of the sheet feed roller 51 as a transport speed.

In the embodiment, the sheet feed roller 51 (roller rotation shaft 61) and the transport roller 54 rotate at the same rotational speed (rotation speed per unit time). On the other hand, a roller diameter D1 of the sheet feed roller 51 is larger than a roller diameter D2 of the transport roller 54. Therefore, in the first cut sheet P1, at the time when the sheet leading edge Pe is held between the transport roller 54 and the driven roller 55, the sheet trailing edge portion is transported more in the transport direction by the sheet feed roller 51 as much as the difference in speed between the peripheral speed of the sheet feed roller 51 and the peripheral speed of the transport roller 54.

Figure 15:
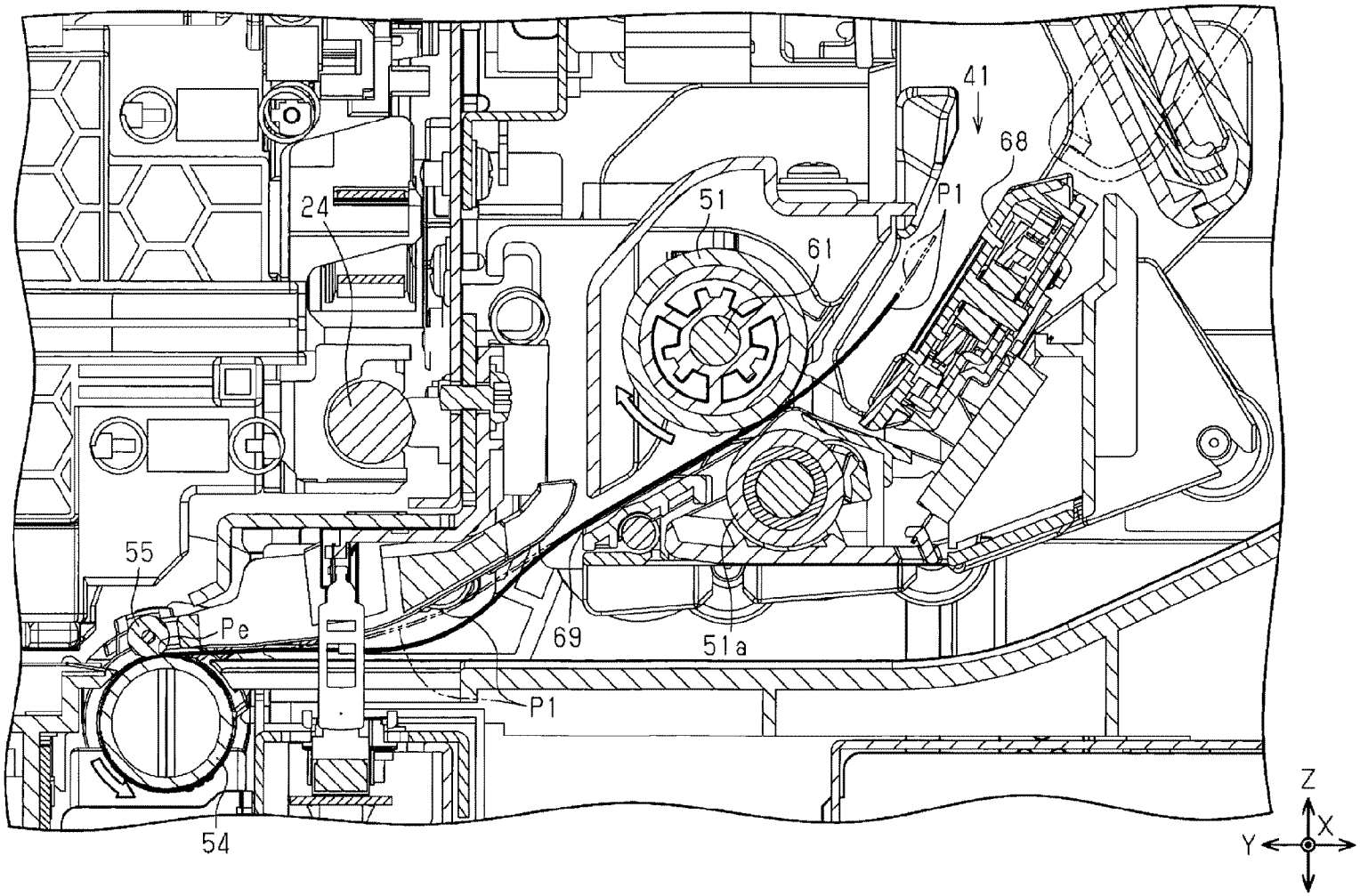
FIG. 15 is a partially enlarged sectional view of the printer illustrating the sheet feed roller and the transport roller that perform skew removal of the recording medium.

The first cut sheet P1 of which the sheet trailing edge portion is transported more in the transport direction by the sheet feed roller 51 as illustrated in FIG. 15 is in a state where bending occurs between the transport roller 54 and the sheet feed roller 51 as illustrated by a two-dot chain line and a solid line in FIG. 15. The first cut sheet P1 is in a state where the sheet leading edge Pe thereof is pushed from behind due to the generated bending and is abutted between the transport roller 54 and the driven roller 55 so that the tilt with respect to the transport direction is corrected (skew removal). Thereafter, the first cut sheet P1 of which the tilt is corrected in this manner is transported to the printing unit 20 in the normal orientation while being held between the rotating transport roller 54 and the driven roller 55.

Incidentally, in the first cut sheet P1 transported to the printing unit 20 by the rotation driving of the transport roller 54, in a case where the sheet trailing edge thereof is transported by the rotation driving of the sheet feed roller 51, the bending between the transport roller 54 and the sheet feed roller 51 is increased and there is a possibility that the transport cannot be performed.

Therefore, in the embodiment, after the first cut sheet P1 is held with the driven roller 55 and is in a state of being transportable by the transport roller 54, the driving force transmitted to the sheet feed roller 51 is released so as not to transmit the driving force, and the sheet feed roller 51 is brought into a state of not transporting the first cut sheet P1.

That is, in the embodiment, at the time when the encoder 66 detects that the sheet feed roller 51 has rotated two turns from the start of the transport of the first cut sheet P1 by the sheet feed roller 51, in the switching mechanism 75, the movement member 71 is moved to the non-transmission position of the driving force where the gear 57 does not mesh with the gear 58, using the movement of the carriage 22. As a result, the driving force transmission unit 70 is switched from a state where the driving force is transmitted to the sheet feed roller 51 to a state where the driving force is not transmitted, and the first cut sheet P1 is held with the driven roller 55 and transported by the transport roller 54.

In a state where the sheet feed roller 51 does not transport the first cut sheet P1, the sheet feed roller 51 in contact with the sheet trailing edge of the first cut sheet P1 transported by the transport roller 54 is rotated by the movement of the sheet trailing edge. In this case, as described with reference to FIG. 10, even when the sheet feed roller 51 rotates by the movement of the sheet trailing edge as illustrated by the hollow arrow in FIG. 10, the rotation of the sheet feed roller 51 idles without being transmitted to the roller rotation shaft 61 whose rotation is stopped by the one-way clutch mechanism 65. Therefore, the influence of the sheet feed roller 51 on the transport of the first cut sheet P1 by the transport roller 54 is suppressed.

According to the above embodiment, the following effects can be obtained. (1) It is possible to easily and simultaneously drive two drive rollers of the sheet feed roller 51 and the transport roller 54 easily by the single motor, and to easily perform the skew removal of the first cut sheet P1 transported in the transport direction by two drive rollers driven simultaneously.

(2) Since the roller diameter D1 of the sheet feed roller 51 is larger than the roller diameter D2 of the transport roller 54, it is possible to easily cause the transport speed of the first cut sheet P1 by the sheet feed roller 51 to be higher than the transport speed of the first cut sheet P1 by the transport roller 54.

(3) After the first cut sheet P1 is in a state of being transportable by the transport roller 54, since the driving force transmission unit 70 does not transmit the driving force to the sheet feed roller 51, it is possible to stably transport the first cut sheet P1 in the transport direction in the skew removed state by the transport roller 54. In addition, it is possible to suppress unnecessary transport of the first cut sheet P1 by the sheet feed roller 51.

(4) Since the driving force for the sheet feed roller 51 is switched between transmission and non-transmission by the movement of the carriage 22, it is possible to switch the transmission of the driving force to the sheet feed roller 51 by utilizing the printing unit 20.

The above embodiment may be modified as in the following modified example. In addition, the above embodiment and the following modified example may be arbitrarily combined. •In the above embodiment, the rotational speed of the sheet feed roller 51 when driven simultaneously by the single motor (drive portion) may be higher than the rotational speed of the transport roller 54. For example, the number of teeth of the gear 57 is increased while the number of teeth of the gear 58 is reduced, so that the rotational speed of the gear 58 may be higher than that in the above embodiment. In this case, the roller diameter D1 of the sheet feed roller 51 may be the same size (same diameter) as the roller diameter D2 of the transport roller 54. Alternatively, in a range where the peripheral speed of the sheet feed roller 51 is higher than the peripheral speed of the transport roller 54, the roller diameter D1 of the sheet feed roller 51 may be smaller than the roller diameter D2 of the transport roller 54.

According to this modification, the following effects are obtained in addition to the effects (1), (3), and (4) in the above embodiment. (5) In a state of being simultaneously driven by the single motor, it is possible to easily cause the transport speed of the first cut sheet P1 by the sheet feed roller 51 to be easily higher than the transport speed of the first cut sheet P1 by the transport roller 54.

In the above embodiment, the driving force transmission unit 70 may not necessarily have the switching mechanism 75 that switches the driving force to the sheet feed roller 51 between the transmission and the non-transmission by the movement of the carriage 22. For example, the switching mechanism 75 includes an actuator that operates by a solenoid (electromagnet), pneumatic pressure, or the like, and the movement member 71 may be moved in the width direction X by this actuator.

In the above embodiment, the driving force transmission unit 70 may not necessarily release the driving force transmitted to the sheet feed roller 51 so as not to transmit the driving force after the first cut sheet P1 is in a state of being transportable by the transport roller 54. For example, in the first cut sheet P1 transported to the printing unit 20 by the rotation of the transport roller 54, even when the sheet trailing edge is transported by the rotation driving of the sheet feed roller 51, this may be done in a case where the bending occurring between the transport roller 54 and the sheet feed roller 51 does not affect the transport of the first cut sheet P1 by the transport roller 54. In this modified example, it is not necessary to provide the one-way clutch mechanism 65 between the roller rotation shaft 61 and the sheet feed roller 51.

In the printer 11 of the above embodiment, a mounting portion that mounts the liquid container 28 at a position different from that of the carriage 22 may be provided. The mounting portion of the liquid container 28 may be provided inside the casing 12 or outside the casing 12.

In the above embodiment, the liquid can be arbitrarily selected as long as the liquid can be printed on the sheet P by adhering to the sheet P. The liquid may be a liquid in a state when the substance is in a liquid phase, and is a liquid containing a fluid substance such as a liquid material having high or low viscosity, sol, gel water, other inorganic solvent, organic solvent, solution, liquid resin, liquid metal (metal melt), and the like. In addition, the liquid includes not only a liquid as one state of a substance but also a substance in which a particle of a functional material containing a solid such as a pigment or a metal particle is dissolved, dispersed or mixed in a solvent, and the like. Representative examples of liquids include an ink. The ink includes various types of liquid compositions such as general water-based ink and oil-based ink, gel ink, hot melt ink, and the like.

In the above embodiment, the sheet P serving as a recording medium can be arbitrarily selected from high quality paper, medium quality paper, coated paper coated with paint on paper, Japanese paper, and the like. •The printer 11 of the above embodiment is an apparatus (recording apparatus) that prints images such as a character, a picture, a photograph, and the like by attaching a liquid such as an ink or a fluid such as a toner to the sheet P, and may include a serial printer, a lateral type printer, a line printer, a page printer, or the like. In addition, an offset printing apparatus, a textile printing apparatus, or the like may be included. In addition, the recording apparatus may have at least a printing function of printing on the recording medium, and may be a multifunctional machine having functions other than a printing function.

This application claims priority under 35 U.S.C. § 119 to Japanese Patent Application No. 2017-065584, filed Mar. 29, 2017. The entire disclosure of Japanese Patent Application No. 2017-065584 is hereby incorporated herein by reference.

What is claimed is:

1. A recording apparatus comprising:

a recording unit that performs a recording on a recording medium;

a medium mounted unit on which the recording medium is mounted;

a first drive roller that transports the recording medium in a transport direction from the medium mounted unit toward the recording unit;

a second drive roller disposed downstream of the first drive roller in the transport direction and that holds the recording medium with a driven roller to transport the recording medium in the transport direction;

a drive portion that drives the first drive roller and the second drive roller, a driving force transmission unit that transmits a driving force from a single drive portion to the first drive roller and switches the driving force to the first drive roller between transmission and non-transmission by movement of a head moving portion, wherein when the first drive roller and the second drive roller are simultaneously driven by the single drive portion, a transport speed of the recording medium by the first drive roller is higher than a transport speed of the recording medium by the second drive roller.

2. The recording apparatus according to claim 1, wherein a roller diameter of the first drive roller is larger than a roller diameter of the second drive roller.

3. The recording apparatus according to claim 1, wherein a rotational speed of the first drive roller when driven simultaneously by the single drive portion is higher than a rotational speed of the second drive roller.

4. The recording apparatus according to claim 1, wherein after the recording medium is held with the driven roller and is in a state of capable of being transported by the second drive roller, the driving force transmission unit releases the driving force transmitted to the first drive roller so as not to transmit the driving force.

5. The recording apparatus according to claim 4, wherein the recording unit includes a recording head that performs a recording on a recording medium, and a head moving portion provided in the recording head, and that is movable in a direction intersecting with the transport direction, and the driving force transmission unit includes a switching mechanism that switches the driving force to the first drive roller between transmission and non-transmission by movement of the head moving portion.

* * * * *